US007214137B2

(12) United States Patent
Arsenault

(10) Patent No.: US 7,214,137 B2
(45) Date of Patent: May 8, 2007

(54) PORTABLE GOLF SWING PRACTICE DEVICE HAVING A SEPARABLE CORD SHIELD INCORPORATED THEREIN

(76) Inventor: Louis Arsenault, 11 Hazelwood Court, Moncton, New Brunswick (CA) E1G 3V9

( * ) Notice: Subject to any disclaimer, the term of this patent is extended or adjusted under 35 U.S.C. 154(b) by 0 days.

(21) Appl. No.: 11/397,751

(22) Filed: Apr. 5, 2006

(65) Prior Publication Data

US 2006/0234802 A1 Oct. 19, 2006

Related U.S. Application Data

(60) Provisional application No. 60/672,551, filed on Apr. 19, 2005.

(51) Int. Cl.
*A63B 69/36* (2006.01)

(52) U.S. Cl. ..... 473/139; 473/147; 273/386; 273/393; 273/405

(58) Field of Classification Search ..... 473/139, 473/141, 143, 144, 145, 146, 147, 149, 386, 473/394, 396; 273/386, 393, 405
See application file for complete search history.

(56) References Cited

U.S. PATENT DOCUMENTS

| | | | | |
|---|---|---|---|---|
| 1,439,338 | A | 12/1922 | Smith | |
| 1,439,339 | A | 12/1922 | Smith | |
| 1,783,733 | A * | 12/1930 | Manassero | 473/396 |
| 1,921,523 | A | 8/1933 | Hart | |
| 2,236,500 | A * | 4/1941 | Gillette | 473/143 |
| 2,656,720 | A | 10/1953 | Sonnett | |
| 3,729,195 | A | 4/1973 | Hutt et al. | |
| 3,754,764 | A | 8/1973 | Manheck | |
| 3,764,140 | A | 10/1973 | Lotfy | |
| 3,829,093 | A | 8/1974 | Abrams | |
| 3,830,504 | A | 8/1974 | Koo | |
| 4,084,822 | A | 4/1978 | Keeton | |
| 4,113,257 | A | 9/1978 | Moffatt | |
| 4,162,790 | A | 7/1979 | Kelsey | |
| 4,240,629 | A | 12/1980 | Song et al. | |
| 4,248,423 | A | 2/1981 | Lotfy | |
| 4,441,716 | A | 4/1984 | Chen | |
| 4,603,862 | A | 8/1986 | Chen | |
| 4,609,197 | A | 9/1986 | Vodin | |
| 4,949,973 | A | 8/1990 | Williamson | |
| 5,142,309 | A | 8/1992 | Lee | |
| 5,386,997 | A | 2/1995 | Smith | |
| 5,417,427 | A | 5/1995 | Doane | |
| 5,702,309 | A | 12/1997 | Lee | |
| 5,782,701 | A | 7/1998 | O'Bryan | |
| 6,659,775 | B1 | 12/2003 | Moy | |

* cited by examiner

*Primary Examiner*—Nini F. Legesse
(74) *Attorney, Agent, or Firm*—Mario Theriault

(57) ABSTRACT

The golf swing practice device has a floor pad; a hollow tee extending upward from a surface of the floor pad, a ball resting on an end of the tee; and an elastic cord attached to the ball and to the floor pad and extending through the tee. The golf swing practice device also has a socket on a lower end of the tee and a bulge on a surface of the pad. The bulge has a forward-facing slot enclosing the strike side of the elastic cord. The socket on the tee encloses the bulge. The socket and the bulge have complementary spherical shapes that are easily but fitly mounted over and into one another. In other aspects of the invention, the floor pad has a ramp on a strike side of the bulge, and a semicircular groove in its surface, on a forward side of the bulge.

10 Claims, 2 Drawing Sheets

PORTABLE GOLF SWING PRACTICE DEVICE HAVING A SEPARABLE CORD SHIELD INCORPORATED THEREIN

This application claims the benefit of U.S. Provisional Application No. 60/672,551, filed on Apr. 19, 2005.

FIELD OF THE INVENTION

This invention pertains to portable golf swing practice devices, and more particularly it pertains to a shield enclosing the tether cord of a golf swing practice device for preventing damaging the cord when the ball is struck low.

BACKGROUND OF THE INVENTION

Portable golf swing practice devices are generally used indoors during winter to exercise a golfer's skills in swinging a golf club with precision. These devices have been in use for many years, and perhaps the most common ones are characterised by their structures, each having a floor pad on which is mounted a golf ball. The ball is held to the floor pad by an elastic cord, or by other tee structure mounted on a slider that is connected to a spring. When the ball is struck, the elastic cord or the spring extends and causes a pointer to record the ball's travel distance. The extension of the spring or of the cord is then converted in yards of theoretical distance the ball could have travelled on a normal golf course. Examples of these golf swing practice devices are described in the following documents;

U.S. Pat. No. 3,830,504 issued to B. B. Koo on Aug. 20, 1974;

U.S. Pat. No. 4,084,822 issued to J. H. Keeton on Apr. 18, 1978;

U.S. Pat. No. 4,609,197 issued to G. M. Vodin on Sep. 2, 1986;

U.S. Pat. No. 5,417,427 issued to M. S. Doane on May 23, 1995.

In another type of similar portable golf practice devices, the elastic cord extends and causes the ball to hit one of several targets on the floor pad so as to leave a mark on the target or to trigger a signal from one or more switches incorporated in the floor pad. The mark on the target or the triggered signal is representative of the theoretical ball direction, velocity or range. Examples of golf practice devices of this other type are described in the following documents:

U.S. Pat. No. 2,656,720 issued to F. W. Sonnett on Oct. 27, 1953;

U.S. Pat. No. 5,386,997 issued to G. C. Smith on Feb. 7, 1995.

Although several portable golf swing practice devices can be found in the prior art, those that are of a particular interest herein are those where the balls are held to the floor pads by means of elastic tether cords. It has been found that these tether cords are particularly vulnerable to shear stresses and cuts. The occurrence of these stresses is particularly noticeable when the ball is struck low. The cords on these devices must be replaced often, or else, the risk of a cord breakage remains high. Therefore, it is believed that there is a market need for a golf swing practice device that has an effective cord shield thereon to minimize transverse shocks on the cord and so that the device can be used safely indoors.

SUMMARY OF THE INVENTION

In the present invention, however, there is provided a golf swing practice device that has an elastic cord enclosed in a separable cord shield. The cord shield is mounted below the golf ball such that it can absorb the impact of a low strike.

More specifically, according to one aspect of the present invention, the golf swing practice device has a floor pad; a hollow tee extending upward from a surface of the floor pad, and a ball resting on an end of the tee. An elastic cord is attached to the ball and to the floor pad and extends through the tee. The golf swing practice device also has a socket on a lower end of the tee and a bulge on a surface of the pad. The bulge has a forward-facing slot therein enclosing the strike side of the elastic cord. The socket on the tee encloses the bulge.

When a ball is struck low, the impact of the club head on the tee causes the socket to slide upward over the bulge or tilt forward about the bulge for absorbing the impact of the club head. A major portion of the impact is redirected upward, whereby direct shear stresses on the elastic cord are substantially reduced.

In another aspect of the present invention, the socket on the tee and the bulge on the floor pad have complementary spherical shapes that are easily but fitly mounted over and into one another. The tee is easily detachable from the bulge to follow the ball during a strike. Because of the detachable aspect of the socket-and-bulge arrangement, the swing of the club is substantially unaffected by the presence of the hollow tee.

In another aspect of the present invention, the golf swing practice device also has a ramp on the floor pad on a strike side of the bulge. This ramp is advantageous for deflecting very low shots that may cut the surface of the socket, or otherwise hit the surface of the socket at a right angle.

In yet another aspect of the present invention, the golf swing practice device has a semi-circular groove in a surface of the floor pad. This semi-circular groove is centred on the bulge, on a forward side of the bulge. The groove is positioned relative to the bulge, to interfere with the return motion of the tee, for catching the rim of the socket on the tee, and for tilting the tee to a vertical alignment over the bulge.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

One embodiment of the present invention is illustrated in the accompanying drawings, in which like numerals denote like parts throughout the several views, and in which.

DESCRIPTION OF THE PREFERRED EMBODIMENT

Figure 1:
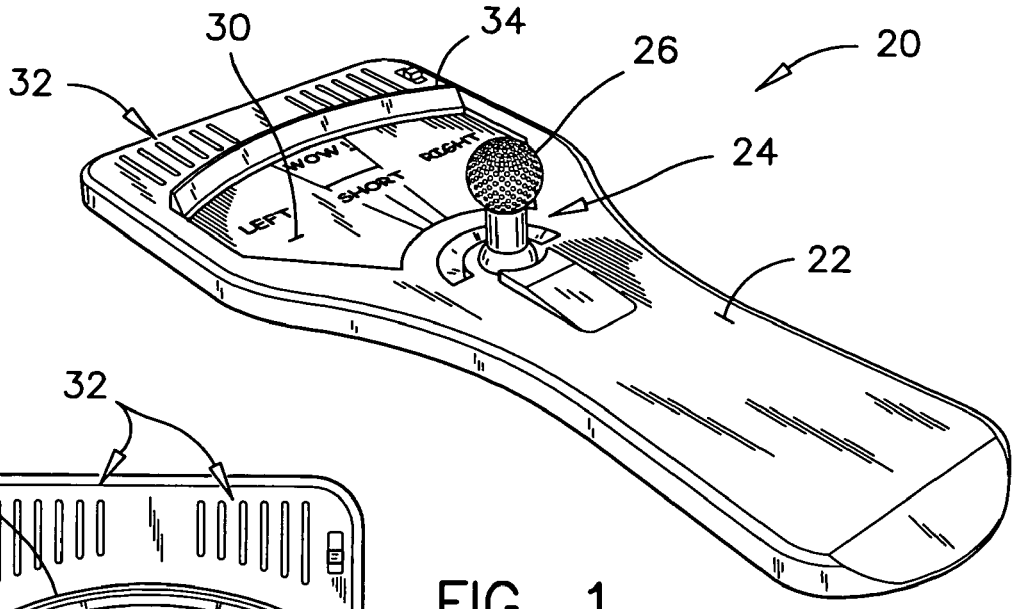
FIG. 1 is a perspective rear and left side view of the golf swing practice device having the separable bulge-and-socket shield according to the preferred embodiment incorporated therein.

While this invention is susceptible of an embodiment in many different forms, there is shown in the drawings and will be described in details herein one specific embodiment of a separable cord shield and a cord tensioning arrangement for a golf swing practice device. The present disclosure is to be considered as an example of the principles of the invention and is not intended to limit the invention to the embodiment illustrated and described.

Although efforts have been made to limit the use of precise dimensions and exact geometric qualifiers, some narrow expressions remain in this disclosure and are used for convenience only to provide a better understanding of the present invention. Such dimensions and shapes can vary from one model of golf swing practice device to another. Therefore the dimensions and geometric expressions mentioned herein should not be considered as being absolute and limiting.

Figure 2:
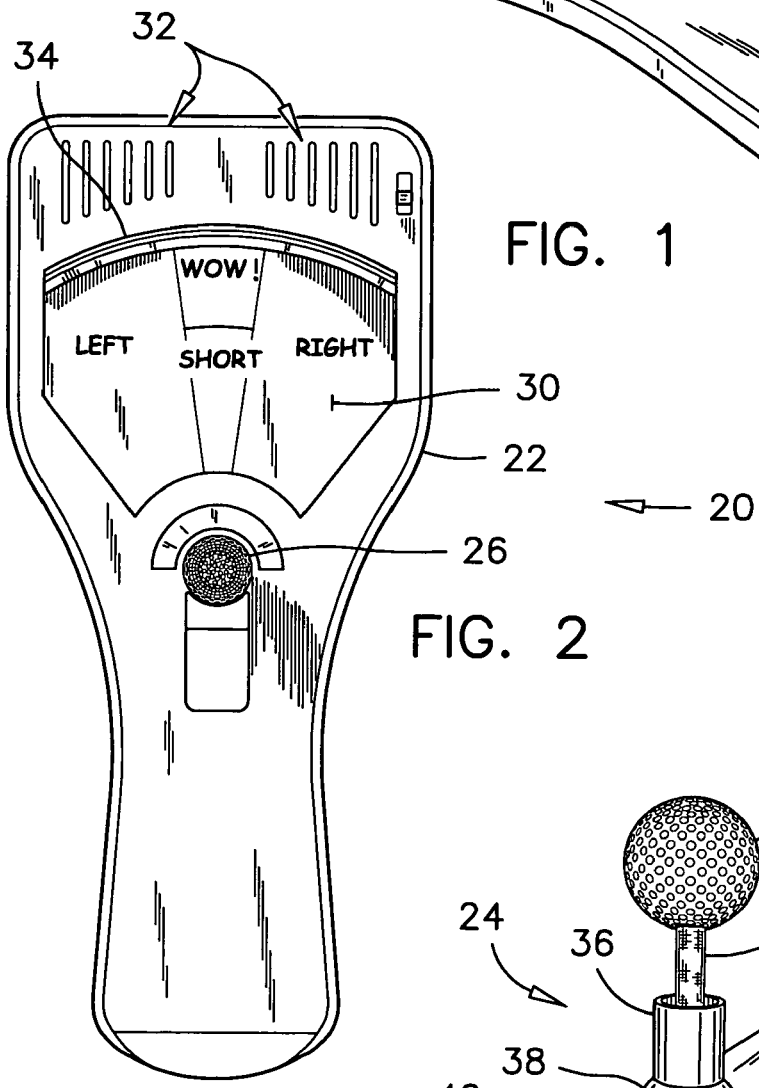
FIG. 2 is a top view of the preferred golf swing practice device.
Figure 3:
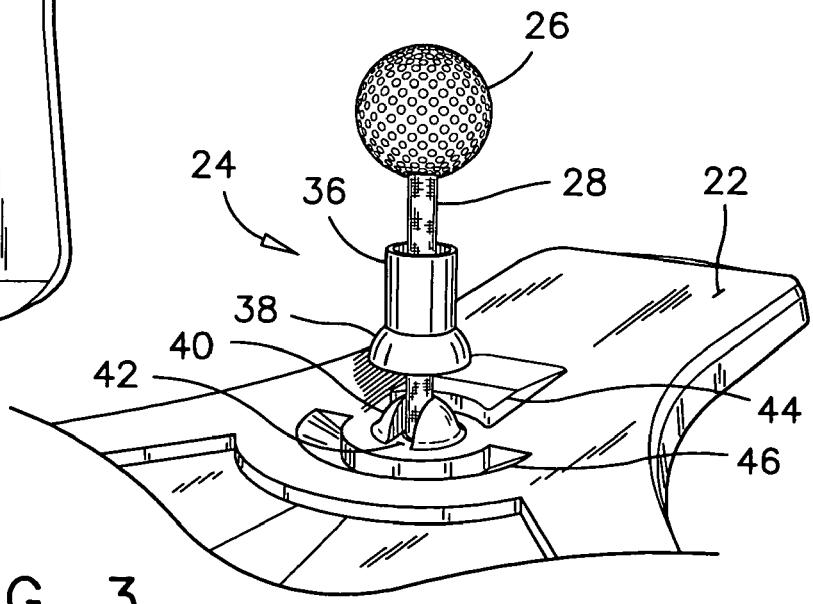
FIG. 3 is a partial front and left perspective view of the separable bulge-and-socket shield according to the preferred embodiment, in an extended mode.

Referring to FIGS. 1–3, the golf swing practice device 20 according to the preferred embodiment comprises a floor pad 22 on which is mounted a hollow tee 24. A golf ball 26 is set on that tee. The ball 26 is held to the pad 22 by an elastic cord 28 fastened to the ball 26 and to the pad 22. The cord 28 extends through the tee 24 and through the pad 22 and is fastened to the bottom surface of the pad, as it will be explained later. When the ball is struck, it travels only a short distance and is pulled back onto the tee 24 by the elastic cord 28.

A number of sensors (not shown) may be incorporated into or over a target surface 30 of the pad 22, to record the direction and distance travelled by the ball 26 at every strike. Circuitry, instrumentation and a micro-controller (not shown) may be provided to emit audible signals or to generate audible messages through speakers (not shown) in response to signals from the sensors, to indicate a theoretical distance and direction of travel of the ball at every strike. The speakers are preferably mounted in a speaker compartment 32 in a forward region of the pad 22. A bumper 34 is preferably provided on a forward edge of the target surface 30, to protect the speaker compartment 32 from strong shots.

Details of the switches and circuitry incorporated in the preferred golf swing practice device are not provided because these details are not the focus of the present invention. These details are known to those skilled in the art of electronics.

The tee 24 has a hollow cylindrical stem 36 and a spherical socket 38 on its lower end. The floor pad 22 has a spherical bulge 40 thereon, through the centre of which the elastic cord 28 extends. The spherical bulge 40 has a slot 42 therein enclosing the strike side of the cord 28. The slot 42 has an open side facing a forward direction toward a target surface 30 of the pad.

Preferably, the hole (not shown) in which the cord 28 extends through the pad 22 has large fillets on its ends. The radii of these fillets should be at least as much as the cord's radius.

The inside radius of the socket 38 is substantially a same dimension or slightly larger than the outside radius of the spherical bulge 40, such that the socket 38 sits easily but precisely over the spherical bulge 40.

In use, an initial tension is set in the elastic cord 28 to pull the socket 38 of the tee 36 firmly against the spherical bulge 40 as shown in FIG. 1. When the ball is struck, the tee 24 tilts over in the direction of the swing, and separates from the bulge 40. The ball 26 accelerates away from the tee 24.

If the ball is struck low, on the stem 36 of the tee for example, the tee 24 is forced to climb up the bulge 40 or to tilt about the bulge 40 thereby changing the direction of the impact force on the cord from horizontal to vertical, whereby the elastic cord 28 is not subject to large shearing forces at a point where the cord 28 exits the pad 22. These shearing forces are largely absorbed and dissipated by the sliding motion of the socket 38 over the bulge 40.

After the force of the swing has been diverted upward by the tee 24, the tee 24 slides away along the cord 28, following the ball 26, such as in the movement of a regular tee. Because the tee 24 separates from the bulge 40 during a strike, it has little effect on the swing of the club.

A set of two or more tees 24 each having a different height is preferably provided with each practice device 20 such that a user can install whichever tee is more appropriate to the type of golf club that will be used during a practice session.

In order to further prevent shearing stresses on the socket-and-bulge arrangement and on the elastic cord 28, a ramp 44 has been provided on the surface of the floor pad 22, on the strike side of the bulge 40. The purpose of this ramp 44 is to raise a club head during a swing, at least a slight distance from the pad 22 to prevent very a low shot that might cut the surface of the socket 38, or otherwise strike the surface of the socket at a right angle.

A semicircular groove 46 is also provided in the surface of the pad 22. The groove 46 is centred on the spherical bulge 40, on the forward side of the bulge 40. The purpose of this groove 46 is to catch and tilt the tee 24 back onto the spherical bulge 40 when the ball 26 returns to its striking position.

When the ball 26 returns to its initial position after a strike, the groove 46 on the pad 22 catches the rim on the socket 38 of the tee 24 and helps to tilt the tee 24 and the ball 26 back to their vertical alignment. Because of this groove 46, the ball 26 and the tee 24 are efficiently tilted back to their striking positions with very little wobbling of the ball over the tee 24.

Another important feature in the golf swing practice device according to the preferred embodiment is the ability to adjust the cord's tension according to the experience of a golfer, or according to a specific strike range with which a golfer wants to practice. This feature will be explained while making reference to FIG. 4.

Figure 4:
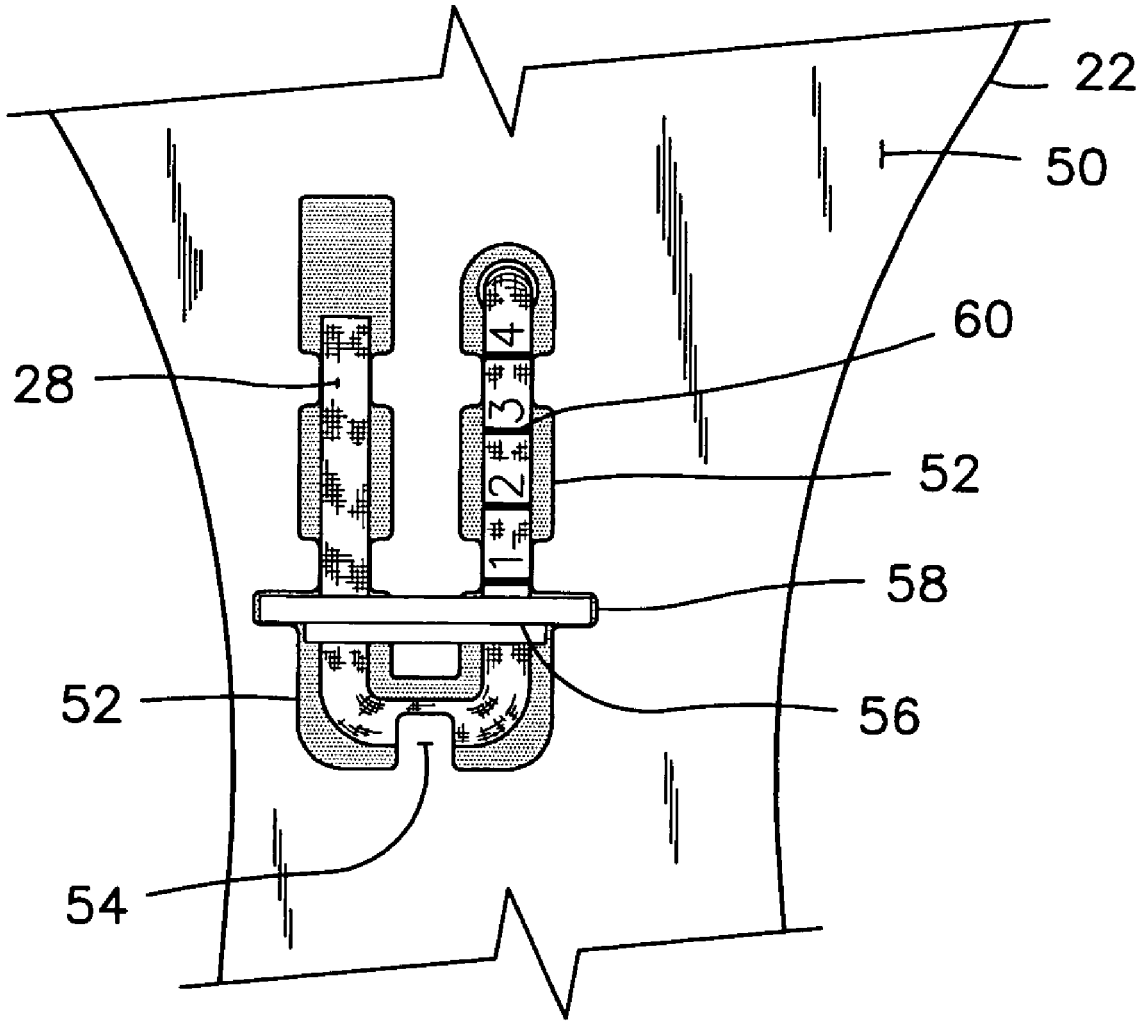
FIG. 4 is a bottom view of the preferred golf swing practice device showing an anchor groove and an anchor bar incorporated therein for retaining, and for setting different tensions in, the elastic cord.

In FIG. 4, the bottom surface 50 of the floor pad 22 is illustrated. A U-shaped groove 52 is provided in this bottom surface. The U-shaped groove 52 encloses a tail portion of the elastic cord 28. This U-shaped groove 52 has hills and valleys therein (not shown) and one or more retaining tabs 54 through which the cord 28 is threaded and held, as it is customary with cord retention systems. An anchor key 56 is mounted across the U-shaped groove 52 and is fitted into a transverse slot 58 extending across the U-shaped groove 52. The key 56 forces the cord into a vertical bend to further retain it, as it is also customary with cord retention systems.

The cord has graduation marks 60 on it at equally spaced intervals. The key 56 constitutes a gauge against which the graduation marks 60 can be read. An adjustment in the tensioning of the elastic cord 28, with the 1 mark against the key 56 corresponds to a strike range of 100 yards for example, when the ball hits the "WOW!" region on the striking surface 30 of the pad 22. Other adjustments correspond to strike ranges of 200, 300 or 400 yards for example.

As to other manner of usage and operation of the present invention, the same should be apparent from the above description and accompanying drawings, and accordingly further discussion relative to the manner of usage and operation of the invention would be considered repetitious and is not provided.

While one embodiment of the golf swing practice device according to the present invention has been illustrated and described herein above, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

What is claimed is:

1. A golf swing practice device comprising a floor pad; a hollow tee extending upward from a surface of said floor pad, a ball resting on an end of said tee; and an elastic cord attached to said ball and to said floor pad and extending through said tee; wherein the improvement comprises;

a socket on a lower end of said tee and a bulge on a surface of said pad, said bulge having a slot therein; said slot enclosing a strike side of said elastic cord, and said socket enclosing said bulge.

2. The golf swing practice device as claimed in claim 1, wherein said socket and said bulge have complementary spherical shapes.

3. The golf swing practice device as claimed in claim 1, further comprising a ramp on said floor pad on a strike side of said bulge.

4. The golf swing practice device as claimed in claim 1, further comprising a semicircular groove in a surface of said floor pad, centred on said bulge on a forward side of said bulge.

5. The golf swing practice device as claimed in claim 1, wherein said slot has an open side facing a forward direction of said floor pad.

6. A golf swing practice device comprising a floor pad; a hollow tee extending upward from a surface of said floor pad, a ball resting on an end of said tee; and an elastic cord attached to said ball and to said floor pad and extending through said tee; wherein the improvement comprises;

a socket on a lower end of said tee and a bulge on a surface of said pad, said bulge having a slot therein; said slot enclosing a strike side of said elastic cord, and said socket being detachably mounted over said bulge and enclosing said bulge.

7. The golf swing practice device as claimed in claim 6, wherein said socket and said bulge have complementary spherical shapes.

8. The golf swing practice device as claimed in claim 6, wherein said slot has an open side facing a forward direction of said floor pad.

9. A golf swing practice device comprising a floor pad; a hollow tee extending upward from a surface of said floor pad, a ball resting on an end of said tee; and an elastic cord attached to said ball and to said floor pad and extending through said tee; wherein the improvement comprises;

a socket on a lower end of said tee and a bulge on a surface of said pad, said bulge having a slot therein; said slot enclosing a strike side of said elastic cord;

said socket being detachably mounted over said bulge and enclosing said bulge; and means in said floor pad for adjusting a tension in said elastic cord.

10. The golf swing practice device as claimed in claim 9, further comprising a ramp on said floor pad on a strike side of said bulge; and a semicircular groove in a surface of said floor pad, centred on said bulge on a forward side of said bulge.

* * * * *